US005349706A

United States Patent [19]

Keer

[11] Patent Number: 5,349,706

[45] Date of Patent: Sep. 27, 1994

[54] WORK BELTS WITH LUMBAR SUPPORTS, STRETCHABLE SIDE PANELS AND INTERCHANGEABLE POUCHES

[76] Inventor: Timothy S. Keer, 101 E. Phillips St., Coaldale, Pa. 18218

[21] Appl. No.: 172,911

[22] Filed: Dec. 27, 1993

[51] Int. Cl.[5] ..... A41F 19/00

[52] U.S. Cl. ..... 2/300; 2/44; 2/311; 224/224; 224/216; 224/253

[58] Field of Search ..... 2/300, 336, 338, 311, 2/268, 44; 602/19, 20; 482/106, 139; 450/155; 128/100.1, 101.1, 121.1, 96.1; 224/215, 216, 224, 240, 253, 259, 904

[56] References Cited

U.S. PATENT DOCUMENTS

| | | | |
|---|---|---|---|
| 770,761 | 9/1904 | Lemly | 224/216 |
| 1,504,030 | 8/1924 | Dettweiler | 224/224 |
| 1,530,342 | 3/1925 | Barber | 224/224 |
| 1,597,734 | 8/1926 | Sousa, Jr. | 224/253 |
| 1,600,027 | 9/1926 | Welsand | 224/904 |
| 2,397,200 | 3/1946 | Perry | 224/253 |
| 3,784,987 | 1/1974 | Bryant | 2/338 |
| 4,968,027 | 11/1990 | Anderson | 2/338 |
| 5,040,524 | 8/1991 | Votel et al. | 128/101.1 |
| 5,046,488 | 9/1991 | Schiek, Sr. | 602/19 |
| 5,064,108 | 11/1991 | Headley | 224/253 |
| 5,148,549 | 9/1992 | Sydor | 2/44 |
| 5,176,131 | 1/1993 | Votel et al. | 602/19 |
| 5,178,163 | 1/1993 | Yewer, Jr. | 602/19 |
| 5,205,814 | 4/1993 | Lundrigan et al. | 602/19 |
| 5,240,156 | 8/1993 | Sicotte et al. | 224/224 |

FOREIGN PATENT DOCUMENTS

| | | | |
|---|---|---|---|
| 1164277 | 10/1958 | France | 2/300 |

*Primary Examiner*—Clifford D. Crowder
*Assistant Examiner*—Gloria Hale
*Attorney, Agent, or Firm*—Michael J. Colitz, Jr.

[57] ABSTRACT

A work belt with lumbar support, stretchable side panels and interchangeable pouches comprising a main belt structure having a buckle at one end and holes at the other end for removable coupling with respect to the buckle and with a central section of an increased height, a lumbar support extending laterally within the central section and fabricated of an elastomeric material, elastic panels secured to the belt at locations laterally spaced from the lumbar support, pouch support straps located on the belt laterally disposed on opposite sides of the lumbar support for receiving any one of a plurality of interchangeable pockets, suspender straps permanently secured to a central extent of the belt structure with opposite ends releasably secured to the upper edges of the belt near the buckle and holes, and a plurality of interchangeable pockets adapted to be secured to the support straps.

5 Claims, 4 Drawing Sheets

WORK BELTS WITH LUMBAR SUPPORTS, STRETCHABLE SIDE PANELS AND INTERCHANGEABLE POUCHES

BACKGROUND OF THE INVENTION

1. Field of the Invention

The present invention relates to work belts with lumbar supports, stretchable side panels and interchangeable pouches and more particularly pertains to increasing lumbar support through a work belt while increasing access to work implements.

2. Description of the Prior Art

The use of work belts is known in the prior art. More specifically, work belts heretofore devised and utilized for the purpose of increasing lumbar support through work belts are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 3,784,987 to Bryant discloses an article of clothing including a combined belt and suspender arrangement.

U.S. Pat. Nos. 5,040,524, 5,176,131 both to Votel and U.S. Pat. No. 5,178,163 to Yewer disclose a back supports.

Lastly, U.S. Pat. No. 5,148,549 to Syder discloses a back support with side openings and attached apron.

In this respect, the work belts with lumbar supports, stretchable side panels and interchangeable pouches according to the present invention substantially depart from the conventional concepts and designs of the prior art, and in doing so provide an apparatus primarily developed for the purpose of increasing lumbar support through a work belt while increasing access to work implements.

Therefore, it can be appreciated that there exists a continuing need for new and improved work belts with lumbar supports, stretchable side panels and interchangeable pouches which can be used for increasing lumbar support through a work belt while increasing access to work implements. In this regard, the present invention substantially fulfills this need.

SUMMARY OF THE INVENTION

In view of the foregoing disadvantages inherent in the known types of work belts now present in the prior art, the present invention provides improved work belts with lumbar supports, stretchable side panels and interchangeable pouches. As such, the general purpose of the present invention, which will be described subsequently in greater detail, is to provide new and improved work belts with lumbar supports, stretchable side panels and interchangeable pouches and method which has all the advantages of the prior art and none of the disadvantages.

To attain this, the present invention essentially comprises a new and improved work belt with lumbar support, stretchable side panels and interchangeable pouches comprising a main belt structure having a buckle at one end and holes at the outer end for removable coupling with respect to the buckle at the front of and with a central section of an increased height at the back of a wearer, a lumbar support at the back of a wearer extending laterally within the central section and fabricated of a elastomeric material, elastic panels secured to the belt at locations laterally spaced from the lumbar support at the sides of the wearer, suspender straps permanently secured to a central extent of the belt structure with opposite ends releasably secured to the upper edges of the belt near the buckle and holes, pouch support straps located on the belt laterally disposed on opposite sides of the lumbar support for receiving any one of a plurality of interchangeable pockets, a plurality of interchangeable pockets adapted to be secured to the support straps, and inflation means adapted to be releasably coupled to the lumbar support for the inflation of the lumbar support to a predetermined extent to provide the desired support to a wearer.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved work belts with lumbar supports, stretchable side panels and interchangeable pouches which have all the advantages of the prior art work belts and none of the disadvantages.

It is another object of the present invention to provide new and improved work belts with lumbar supports, stretchable side panels and interchangeable pouches which may be easily and efficiently manufactured and marketed.

It is further object of the present invention to provide new and improved work belts with lumbar supports, stretchable side panels and interchangeable pouches which are of durable and reliable constructions.

An even further object of the present invention is to provide new and improved work belts with lumbar supports, stretchable side panels and interchangeable pouches which are susceptible of a low cost of manufacture with regard to both materials and labor, and which accordingly are then susceptible of low prices of sale to the consuming public, thereby making such work belts with lumbar supports, stretchable side panels and interchangeable pouches economically available to the buying public.

Still yet another object of the present invention is to provide new and improved work belts with lumbar supports, stretchable side panels and interchangeable pouches which provide in the apparatuses and methods of the prior art some of the advantages thereof, while simultaneously overcoming some of the disadvantages normally associated therewith.

Still another object of the present invention is to increase lumbar support through a work belt while increasing access to work implements.

Lastly, it is an object of the present invention to provide new and improved work belts with lumbar support, stretchable side panels and interchangeable pouches comprising a main belt structure which has a buckle at one end and holes at the other end for removable coupling with respect to the buckle and with a central section of an increased height. A lumbar support extends laterally within the central section and is fabricated of a elastomeric material. Elastic panels are secured to the belt at locations laterally spaced from the lumbar support. Pouch support straps are located on the belt laterally disposed on opposite sides of the lumbar support for receiving any one of a plurality of interchangeable pockets. Suspender straps are permanently secured to a central extent of the belt structure with opposite ends releasably secured to the upper edges of the belt near the buckle and holes. A plurality of interchangeable pockets adapt to be secured to the support straps.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
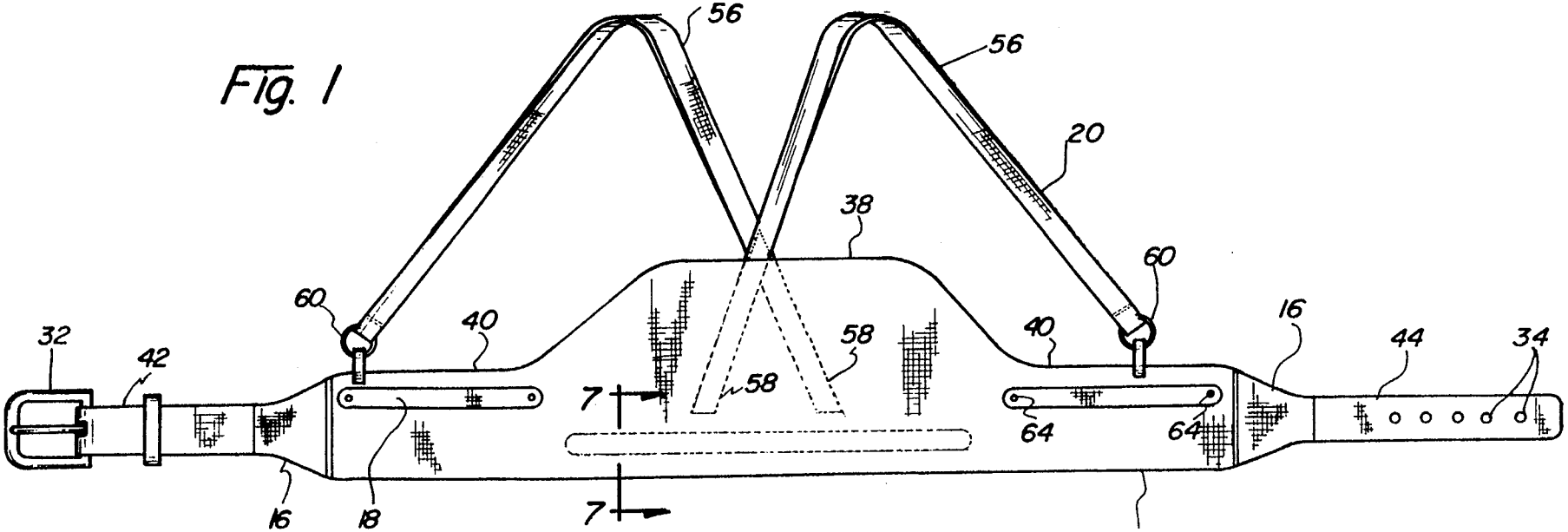
FIG. 1 is a plan view of the preferred embodiment of the work belts with lumbar supports, stretchable side panels and interchangeable pouches constructed in accordance with the principles of the present invention.
Figure 2:
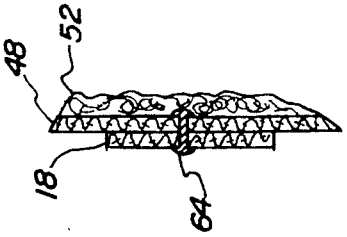
FIG. 2 is a cross-sectional view taken along line 2—2 of FIG. 1.

With reference now to the drawings, and in particular to FIG. 1 thereof, the preferred embodiment of the new and improved work belts with lumbar supports, stretchable side panels and interchangeable pouches embodying the principles and concepts of the present invention and generally designated by the reference numeral 10 will be described.

More specifically, it will be noted in FIGS. 1–7 the primary embodiment of the new and improved work belt with lumbar supports, stretchable side panels and interchangeable pouches constructed in accordance with the principles of the present invention. From its broadest context, the work belt 10 is a system. Such system comprises a plurality of component parts including the main belt structure 12, a lumbar support 14, elastic panels 16, pouch support strap 18, suspender straps 20, as well as a plurality of interchangeable pockets 24, 26 and 28.

More specifically, the main belt structure 12 is constructed to have a buckle 32 at one end with holes 34 at the other end. The buckle and holes cooperate for removable coupling with respect to each other. During operation and use, the buckle and holes are located at the front of a wearer. A central section is provided of an increased height. In the preferred embodiment, the central section includes a high central section located at the back of the wearer and intermediate height sections 40 between the central section and the end sections 42 and 44 which are of a reduced height. Tapering sections couple the sections of the belt structure as it decreases height from the central extent to the end extents.

The next major component of the belt system is the lumbar support 14. The lumbar support includes a laterally extending elastomeric component. It is of an extent to extend from the center portion of the wearer's back forwardly adjacent to the sides of the wearer. It is located within the belt between an exterior layer 48 and interior layer 50 both formed of an inextensible material such as nylon. Filler padding 52 is located between the inner and outer layers 48 and 50 for support and for holding the lumbar support in position. The periphery of the interior and exterior layers are stitched or otherwise secured to feel the lumbar support 14 in proper position between the layers 48 and 50 of the main belt structure 12.

The next major components of the belt system are the suspender straps 20. Two such straps 20 of similar construction are preferably utilized. They are secured at their first ends 58 to the central extent 38 of the belt above the lumbar support 14. Their opposite ends 60 are releasably secured to the intermediate sections of the belt 40. Appropriate clasps allow for the coupling and the uncoupling of the ends 60 of the suspender straps 20 with respect to the belt at the front of the wearer. Such location is near the buckle 32 and holes 34.

Located on the main belt structure 12 between the end portion 42 and 44 and the intermediate portions 40 are a pair of flexible, elastomeric panels 16. Such panels allow for a limited degree of stretching of the ends of the belt with respect to the central section 38 of the belt. This arrangement provides for added support to the user through the lumbar support.

Next provided are a plurality of pouch support straps 12. Such pouch support straps are located on the belt extending from the sides of the wearer toward the front of the wearer. They are located on the front of the belt laterally exposed on opposite sides of the lumbar support 14. They are permanently coupled to the main belt structure by rivets 64. As such, the central extent of the pouch support straps are normally in contact with the exterior layer 48 of the main belt structure but may be spaced therefrom for supporting pouches as may be desired by a user.

Figure 3:
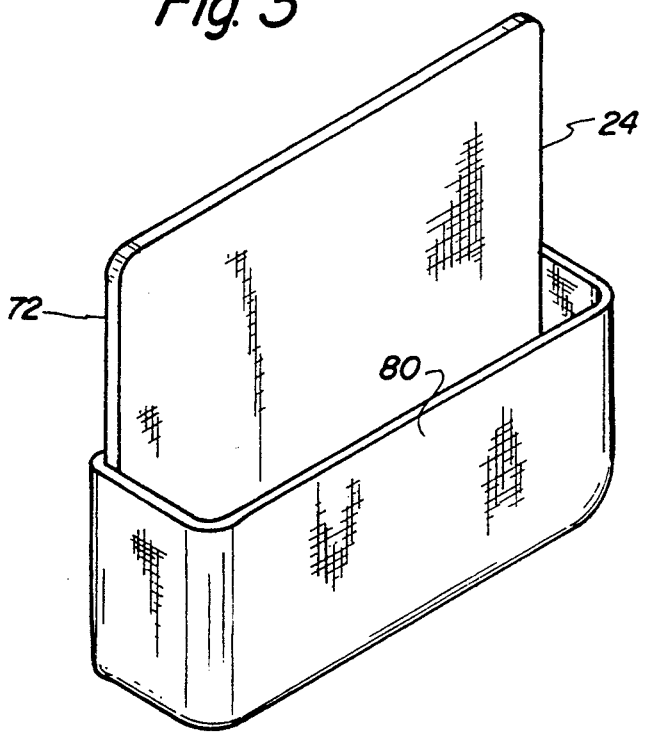
FIG. 3 is a perspective view of an interchangeable pocket for use with the belt shown in FIG. 1.
Figure 4:
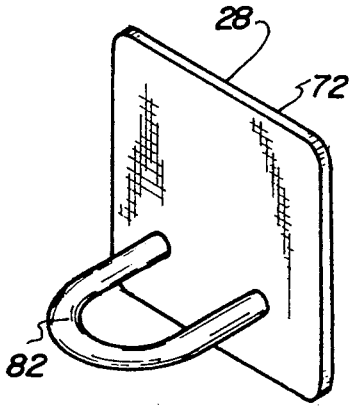
FIG. 4 is a perspective view of an interchangeable pocket for use with the belt shown in FIG. 1.
Figure 5:
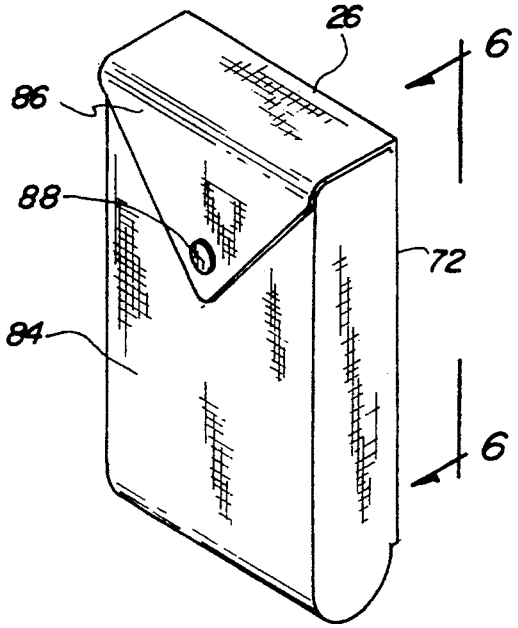
FIG. 5 is a perspective view of an interchangeable pocket for use with the belt shown in FIG. 1.
Figure 6:
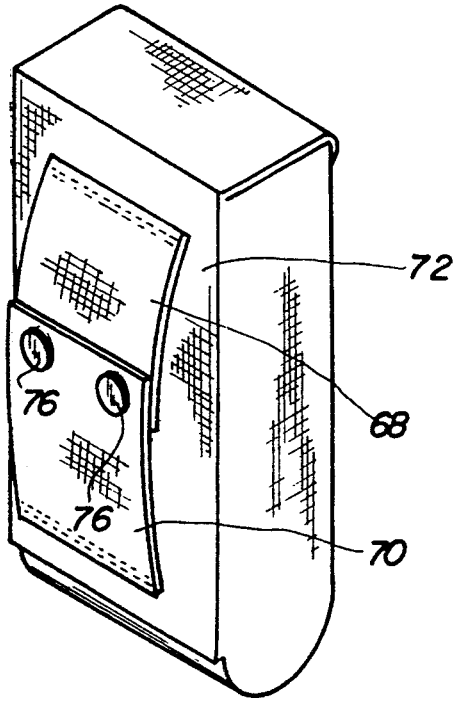
FIG. 6 is perspective view of an interchangeable pocket for use with the belt shown in FIG. 1.
Figure 7:
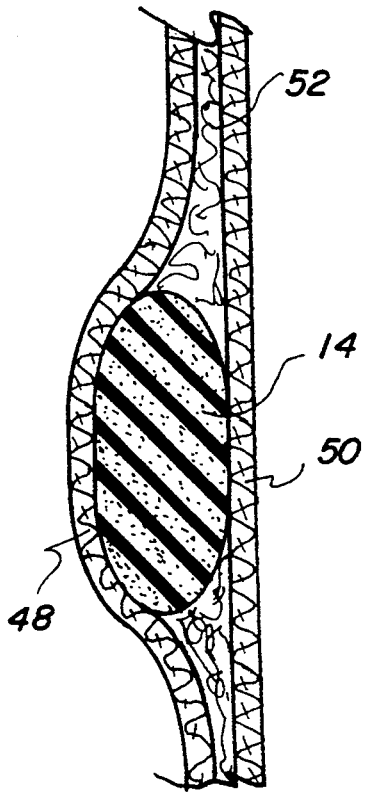
FIG. 7 is a cross-sectional view taken along line 7—7 of FIG. 1.

The interchangeable pouches or pockets 24, 26 and 28 are shown in FIGS. 3, 4 and 5. Each includes a back plate with disconnectable straps 68 and 70 secured at their opposed end to a backing plate 72. The backing plate and snaps are similar in all three pouch or pocket embodiments. The straps are provided with snaps 76 at their adjacent ends. In this manner, the snaps may be separated to separate the straps 68 and 70 and then placed on the pouch support strap 68. Different configured containers are provided on the various pouches. In this FIG. 3, embodiment, an open pocket 80 is simply provided. In the FIG. 4 embodiment, a rigid hook 82 extends outwardly from the backing plate 72 for supporting a hammer or the like. In the FIG. 5 embodiment, a closed compartment 84 is utilized. The open upper end is closed at the discretion of the user by a flap 86 having a snap 88 at its end for opening and closing as desired.

Figure 8:
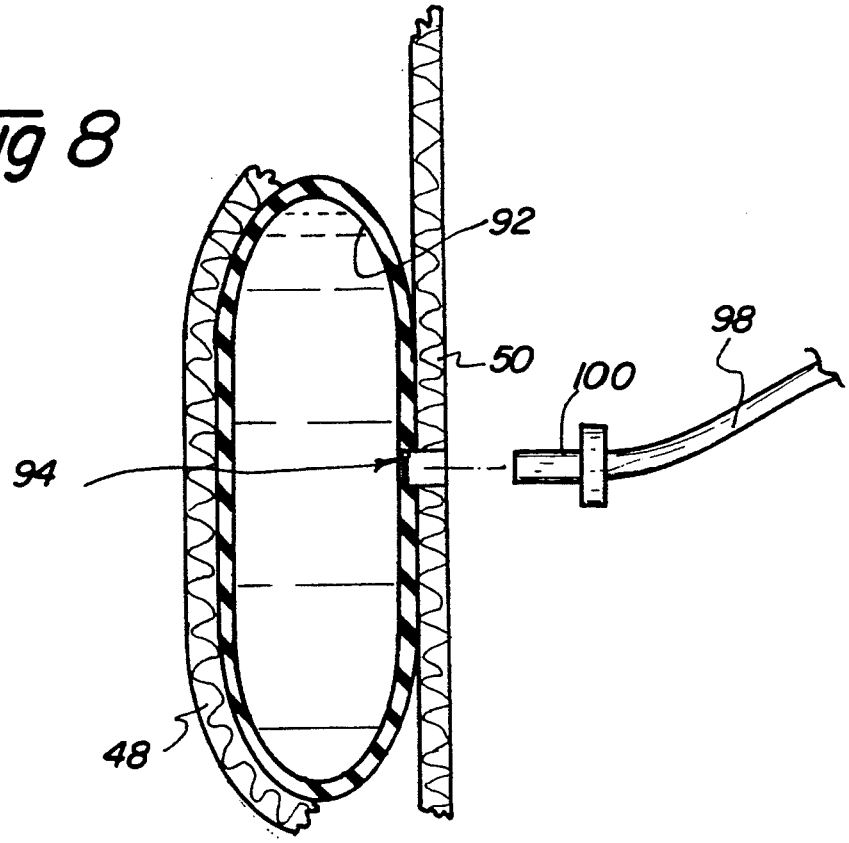
FIG. 8 is a cross-sectional view similar to that of FIG. 7 but illustrating an alternate embodiment of the invention.
Figure 9:
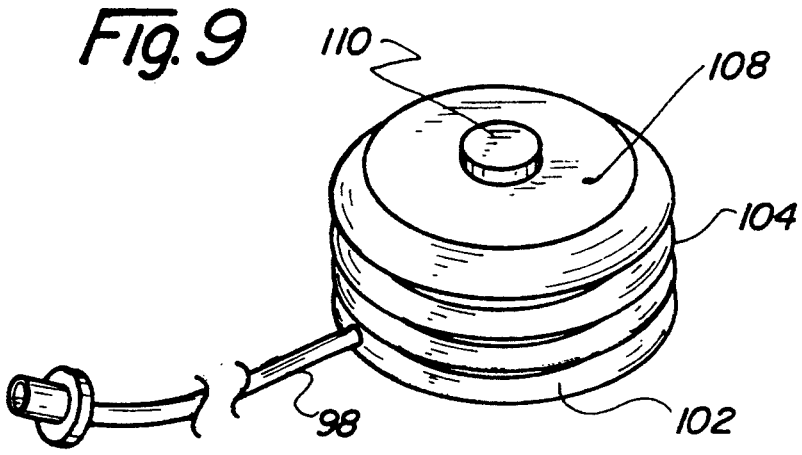
FIG. 9 is a perspective view of a pump used to fill the lumbar support of FIG. 8.

Next provided with the system of the present invention is the alternate embodiment shown in FIGS. 8 and 9. In such embodiment, the lumbar support 14 of the prior embodiment is replaced by a fluid impervious bladder 92. Such bladder may be fabricated of any rubber-like product, natural or synthetic of a blends thereof to retain the fluid content therein. A one-way check valve 94 is provided in one wall thereof at a central portion on the interior fabric 50 of the main belt structure. A flexible line 98 has a nozzle 100 at its outboard end and is coupled to a pump 102 at its inboard end. In this manner, the fluid may be pumped by a user by repeated depressing of the pump with its accordion walls 104 to move the fluid from the interior of the pump through the hose to the nozzle and into the interior of the bladder through the one-way valve 94. When the fluid utilized its air, an air hole 108 is formed in the upper surface of the pump. If an alternative liquid as for example, water is utilized to fill the bladder, a fill cap 110 is formed on the upper central extent of the pump for replenishing the water in the pump. Relieving the fluid from the bladder is effected by simply depressing the one-way valve 94 by the use of any conventional tool to move the valve inwardly from the position shown in FIG. 8.

The present invention is a work belt which fits around the waist and has straps which pass over the shoulders. It is intended for people who work with tools and prefer to have them on their person, within easy reach, without interfering with the freedom of their arms, legs and body. This belt is equally suited for both light and very heavy work, and places less demands on the body. At the end of a very strenuous day, the benefits of this device are very apparent. People engaged in trades like plumbing, wiring, carpentry and the like need this very superior tool belt.

The present invention is made of woven nylon and is very wide and reinforced in the back to support the lumbar area, and has sections on each side which stretch to allow more movement of the body. However, it is narrower in the front so it does not restrict bending. Several types of pouches are available for tools and other implements. They are held in place by short straps attached to the belt. The shoulder straps extend from the front to the back, placing the weight on the shoulders to keep the belt from sagging and sliding down. The straps make the belt much more comfortable to wear.

The improved support and weight distribution obtained with the present invention could be endorsed by insurance companies and other safety groups. There will be less costly injuries and less lost time if the use of this belt is made mandatory. The work will be less fatiguing and more efficient, reducing the labor costs on every job very significantly.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved work belt with lumbar support, stretchable side panels and interchangeable pouches comprising, in combination:

a main belt structure having a buckle at one end and holes at the outer end for removable coupling with respect to the buckle at the front of and with a central section of an increased height at the back of a wearer;

a lumbar support at the back of a wearer extending laterally within the central section and fabricated of a elastomeric material;

elastic panels secured to the belt at locations laterally spaced from the lumbar support at the sides of the wearer;

suspender straps permanently secured to a central extent of the belt structure with opposite ends releasably secured to the upper edges of the belt near the buckle and holes;

pouch support straps located on the belt laterally disposed on opposite sides of the lumbar support for receiving any one of a plurality of interchangeable pockets;

a plurality of interchangeable pockets adapted to be secured to the support straps; and inflation means adapted to be releasably coupled to the lumbar support for the inflation of the lumbar support to a predetermined extent to provide the desired support to a wearer.

2. A work belt with lumbar support, stretchable side panels and interchangeable pouches comprising:

a main belt structure having a buckle at one end and holes at the other end for removable coupling with respect to the buckle and with a central section of an increased height;

a lumbar support extending laterally within the central section and fabricated of a elastomeric material;

elastic panels secured to the belt at locations laterally spaced from the lumbar support;

pouch support straps located on the belt laterally disposed on opposite sides of the lumbar support for receiving any one of a plurality of interchangeable pockets;

suspender straps permanently secured to a central extent of the belt structure with opposite ends releasably secured to the upper edges of the belt near the buckle and holes; and a plurality of interchangeable pockets adapted to be secured to the support straps.

3. The belt as set forth in claim 2, wherein the lumbar support is of a solid cross-sectional configuration.

4. The belt as set forth in claim 2, wherein the lumbar support includes an inflatable bladder positioned in the central extent of the belt structure.

5. The belt as set forth in claim 4, wherein the lumbar support has an associated inflation means adapted to and releasably coupled to the bladder support for the inflation thereof to a predetermined extent.

* * * * *